United States Patent [19]

Vanhoutte

[11] Patent Number: 4,505,480

[45] Date of Patent: Mar. 19, 1985

[54] TENNIS RACKET HAVING ALVEOLI FILLED HONEYCOMB REINFORCEMENT

[75] Inventor: Jan E. Vanhoutte, Brugge, Belgium

[73] Assignee: Fabrique Nationale Herstal, Belgium

[21] Appl. No.: 477,960

[22] Filed: Mar. 23, 1983

[30] Foreign Application Priority Data

Aug. 31, 1982 [BE] Belgium ..... 2/59816

[51] Int. Cl.[3] ..... A63B 49/04

[52] U.S. Cl. ..... 273/73 C; 273/73 J

[58] Field of Search ..... 273/73 F, 73 H, 73 C, 273/73 R, 73 K, 73 G, 73 J, 73 K, 76, 78 R, 82 R, 169, 171, 167 F, 67 A, 230, 82 A, 220; 428/117, 593

[56] References Cited

U.S. PATENT DOCUMENTS

| | | | |
|---|---|---|---|
| 3,822,762 | 7/1974 | Crispin et al. | 428/117 X |
| 3,998,024 | 12/1976 | Frandsen | 428/117 X |
| 4,085,934 | 4/1978 | Churchward | 273/171 |
| 4,175,745 | 11/1979 | Gevers et al. | 273/73 C |
| 4,182,512 | 1/1980 | Kuebler | 273/73 C |

FOREIGN PATENT DOCUMENTS

| | | | |
|---|---|---|---|
| 1095615 | 12/1967 | United Kingdom | 273/117 |

*Primary Examiner*—Richard C. Pinkham
*Assistant Examiner*—Matthew L. Schneider
*Attorney, Agent, or Firm*—Bacon & Thomas

[57] ABSTRACT

The present invention relates to an improvement in racket frames reinforced with a honeycomb, characterized in that it comprises filling up at least one selected alveolus of the said honeycomb with a substance having a density of at least 2 kg/dm3.

4 Claims, 1 Drawing Figure

A tennis racket having a honeycomb structure wherein selected alveoli of the honeycomb are filled with a high density material and a binder in accordance with the invention.

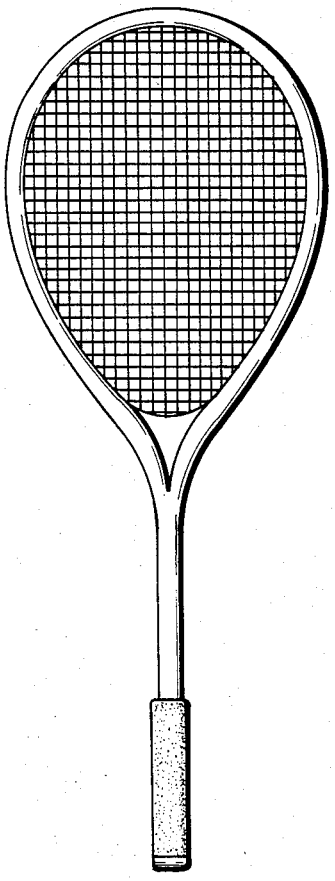
A tennis racket having a honeycomb structure wherein selected alveoli of the honeycomb are filled with a high density material and a binder in accordance with the invention.

TENNIS RACKET HAVING ALVEOLI FILLED HONEYCOMB REINFORCEMENT

BACKGROUND OF THE INVENTION

The present invention relates to an improvement in racket frames reinforced with a honeycomb.

Various embodiments of racket frames have already been proposed, which comprise a honeycomb core (in one or several parts) surrounded with a casing of metal, synthetic material or composite material.

Presently, rackets are commercially available as consisting of two identical metal shells enclosing a strip of a metal honeycomb, the arrangement being assembled by gluing (see Belgian Pat. No. 856.598).

It has also been proposed to form composite racket frames in which are embedded two strips of honeycomb situated on both sides of a core of a swelling synthetic material (see European Patent Application No. 82201002.1).

In a co-pending Belgian patent application filed herewith, applicant describes a tubular means reinforced with a honeycomb, having particularly interesting mechanical properties in a large number of applications, namely the manufacture of racket frames.

The various construction systems briefly described above have a common point in that, during their manufacture, it is possible to determine with a relatively large accuracy the final position of each of the alveoli of the honeycomb in the finished frame.

SUMMARY OF THE INVENTION

Starting from this observation, applicant has derived a simple means for influencing, in any desired manner, the equilibrium or the transverse inertia moment of the racket.

Thus, the improvement according to the invention comprises filling up at least a carefully selected alveolus of the said honeycomb with a substance having a high density. This expression means a substance having a density of at least two kilograms per cubic decimeter (2 kg/dm$^3$).

BRIEF DESCRIPTION OF THE DRAWING

The single FIGURE shows a tennis racket having incorporated therein a preferred embodiment of the invention.

Of course, for the said selection of the alveolus or the alveoli being filled up, in addition to the intended effect, the stresses imposed by the passages being anticipated in the basket of the frame for cording will be taken into consideration.

In each particular considered application, the selection of the said material having a high density will be made as a function of the constituting material or materials of the honeycomb and the casing.

Thus, in the case of a core and a casing of a light aluminium alloy a mixture of an organic binder and a charge of zinc powder will be advantageously selected.

The selected alveolus or alveoles will be filled up at the most appropriate stage of the manufacture of the frame after spreading the honeycomb and before inserting it into a tubular casing or the embedding thereof in the case of a composite manufacture, or after it has been laid in one of the above mentioned half shells.

With reference to the single FIGURE, there is shown a conventional tennis racket having an internal honeycomb structure wherein selected alveoli of the honeycomb are filled with a high density material and a binder in accordance with the practice of the invention.

What I claim is:

1. A frame for a tennis racket defined in part by a honeycomb core, the improvement comprising at least one selected alveolus of the honeycomb core being filled with a substance including a material having a density of at least two kilograms per cubic decimeter and a binder for influencing the equilibrium of the racket.

2. The frame of claim 1 wherein plural selected alveoli of the honeycomb are filled with the substance.

3. The frame of claim 1 wherein the substance includes a mixture of zinc powder and an organic binder.

4. A frame for a tennis racket defined in part by a honeycomb core surrounded by a casing of aluminum alloy, the improvement comprising at least one selected alveolus of the honeycomb core being filled with a mixture of zinc powder and an organic binder.

* * * * *